US009085432B2

(12) United States Patent
Hiyama

(10) Patent No.: US 9,085,432 B2
(45) Date of Patent: Jul. 21, 2015

(54) MEDIUM OVERLAPPED-FEED PREVENTING MECHANISM AND MEDIUM SENDING-OUT DEVICE

(75) Inventor: Chisato Hiyama, Nagano (JP)

(73) Assignee: NIDEC SANKYO CORPORATION (JP)

( * ) Notice: Subject to any disclaimer, the term of this patent is extended or adjusted under 35 U.S.C. 154(b) by 73 days.

(21) Appl. No.: 13/756,965

(22) PCT Filed: Jul. 12, 2011

(86) PCT No.: PCT/JP2011/065883

§ 371 (c)(1),
(2), (4) Date: Feb. 1, 2013

(87) PCT Pub. No.: WO2012/017785

PCT Pub. Date: Feb. 9, 2012

(65) Prior Publication Data

US 2013/0175140 A1 Jul. 11, 2013

(30) Foreign Application Priority Data

Aug. 4, 2010 (JP) ..... 2010-175108

(51) Int. Cl.
*B65H 5/36* (2006.01)
*B65H 3/46* (2006.01)
(Continued)

(52) U.S. Cl.
CPC ..... *B65H 5/36* (2013.01); *B65H 3/063* (2013.01); *B65H 3/46* (2013.01); *B65H 3/5284* (2013.01); *B65H 3/56* (2013.01); *B65H 2701/1914* (2013.01)

(58) Field of Classification Search
CPC ..... B65H 3/46; B65H 3/56; B65H 3/063; B65H 5/36; B65H 2402/53; B65H 2404/50
USPC ..... 271/121, 124, 137, 138
See application file for complete search history.

(56) References Cited

U.S. PATENT DOCUMENTS 5,599,011 A * 2/1997 Schnorr et al. ..... 271/10.11

FOREIGN PATENT DOCUMENTS

JP 62-285832 A 12/1987
JP 64-43036 U 3/1989
(Continued)

OTHER PUBLICATIONS

Machine translation of JP 06-166446 A, retrieved Jun. 10, 2014.*
(Continued)

*Primary Examiner* — Michael McCullough
(74) *Attorney, Agent, or Firm* — Cantor Colburn LLP

(57) ABSTRACT

A medium overlapped-feed preventing may include a feed roller which is structured to abut with the information recording medium and carry the information recording medium; a separation roller oppositely disposed to the feed roller and is urged toward the feed roller and is rotated in the same direction as the feed roller for separating overlapped information recording media which are carried in an overlapped-feed state; and a gate mechanism provided with a gate part through which one piece of the information recording medium is capable of being passed but two pieces of the information recording medium in an overlapped state are unable to be passed. The gate part may disposed on a downstream side in a sending-out direction of the information recording medium with respect to an imaginary line which is formed by connecting a rotation center of the feed roller with a rotation center of the separation roller.

11 Claims, 5 Drawing Sheets

(51) Int. Cl.

| | |
|---|---|
| ***B65H 3/06*** | (2006.01) |
| ***B65H 3/52*** | (2006.01) |
| ***B65H 3/56*** | (2006.01) |

(56) References Cited

FOREIGN PATENT DOCUMENTS

| | | | |
|---|---|---|---|
| JP | 3-28136 | U | 3/1991 |
| JP | 4-106688 | A | 4/1992 |
| JP | 6-166446 | A | 6/1994 |
| JP | 6-87348 | U | 12/1994 |
| JP | 10-188057 | A | 7/1998 |

OTHER PUBLICATIONS

International Search Report for International Application No. PCT/JP2011/065883, mailed Aug. 23, 2011, with English translation.

* cited by examiner

MEDIUM OVERLAPPED-FEED PREVENTING MECHANISM AND MEDIUM SENDING-OUT DEVICE

CROSS REFERENCE TO RELATED APPLICATIONS

This is a U.S. national stage of International Application No. PCT/JP2011/065883, filed on Jul. 12, 2011. Priority under 35 U.S.C. §119(a) and 35 U.S.C. §365(b) is claimed from Japanese Application No. 2010-175108, filed Aug. 4, 2010, the disclosure of which is also incorporated herein by reference.

TECHNICAL FIELD

The present invention relates to a medium overlapped-feed preventing mechanism which is structured to send out an information recording medium one at a time in a state that a plurality of information recording media is overlapped, and relates to a medium sending-out device including the medium overlapped-feed preventing mechanism.

BACKGROUND

Conventionally, a medium separating mechanism has been known in which plural overlapped media are separately carried one at a time (see, for example, Patent Literature 1). In the medium separating mechanism described in Patent Literature 1, a pull-in roller and a feed roller for carrying a medium from an upstream side to a downstream side are disposed on a lower side of a carrying passage in a carrying direction of a medium in a separated state with a predetermined distance therebetween. A tension roller is oppositely disposed to the pull-in roller and the feed roller from an upper side. Further, a reverse rotation roller which is rotated in the same direction as the pull-in roller and the feed roller is disposed on an upper side of the carrying passage between the pull-in roller and the feed roller in the carrying direction. A fixed block having an opposing face which faces the reverse rotation roller is disposed on a lower side of the reverse rotation roller. A space through which one piece of medium is capable of passing but two pieces of medium is unable to pass is formed between the opposing face of the fixed block and the reverse rotation roller.

In the medium separating mechanism described in Patent Literature 1, when two pieces of medium carried in an overlapped state in the upper and lower direction are reached to a position between the reverse rotation roller and the opposing face, since a tip end of an upper side medium is abutted with the reverse rotation roller, a force pushing to the upstream side is applied to the upper side medium by the reverse rotation roller and thus its carrying to the downstream side is prevented. On the other hand, a lower side medium is carried to the downstream side by a carrying force of the pull-in roller. In this manner, in the medium separating mechanism described in Patent Literature 1, overlapped media are separated by utilizing the space which is formed between the opposing face of the fixed block and the reverse rotation roller and the rotating force of the reverse rotation roller.

PATENT LITERATURE

[PTL 1] Japanese Patent Laid-Open No. Hei 10-188057

In the medium separating mechanism described in Patent Literature 1, in a case that a thickness of a medium to be used is relatively large, an upper side medium of two overlapped media is capable of being appropriately abutted with the reverse rotation roller and separated. However, in the medium separating mechanism, in a case that a thickness of a medium to be used is thin, it may be occurred that an upper side medium is not abutted with the reverse rotation roller unless the space between the opposing face of the fixed block and the reverse rotation roller is set with a high degree of accuracy and that the upper side medium is passed through the space between the opposing face of the fixed block and the reverse rotation roller together with the lower side medium. On the other hand, when a thickness of a medium to be used is thin, it is difficult that the space between the opposing face of the fixed block and the reverse rotation roller is set with a high degree of accuracy so that one piece of medium is capable of being passed but two pieces of medium is unable to be passed. Therefore, in the medium separating mechanism described in Patent Literature 1, when a thickness of a medium to be used is thin, a situation may be occurred in which overlapped media are not separated.

SUMMARY

In view of the problem described above at least an embodiment of present invention provides a medium overlapped-feed preventing mechanism which is capable of appropriately separating overlapped information recording media from each other which are carried in an overlapped state regardless of a thickness of the information recording medium to be used. Further, at least an embodiment of present invention provides a medium sending-out device provided with the medium overlapped-feed preventing mechanism.

In order to attain the above benefits, at least an embodiment of the present invention provides a medium overlapped-feed preventing mechanism which is structured to send out an information recording medium one at a time in a state that a plurality of information recording media is overlapped. The medium multi-feed preventing mechanism includes a feed roller which is structured to abut with the information recording medium and carry the information recording medium, a separation roller which is oppositely disposed to the feed roller and is urged toward the feed roller and is rotated in the same direction as the feed roller for separating overlapped information recording media which are carried in an overlapped state, and a gate mechanism provided with a gate part through which one piece of the information recording medium is capable of being passed but two pieces of the information recording medium in an overlapped state are unable to be passed. The gate part is disposed on a downstream side in a sending-out direction of the information recording medium with respect to an imaginary line which is formed by connecting a rotation center of the feed roller with a rotation center of the separation roller.

In the medium overlapped-feed preventing mechanism in accordance with at least an embodiment of the present invention, the separation roller for separating overlapped information recording media from each other which are carried in an overlapped state is oppositely disposed to the feed roller and is urged toward the feed roller. Therefore, when an information recording medium is to be passed through a position between the feed roller and the separation roller, the separation roller is moved to a direction approaching the feed roller and a direction away from the feed roller depending on a thickness of the information recording medium to be used. Accordingly, the separation roller is abutted with the information recording medium regardless of a thickness of the information recording medium to be used. As a result, according to at least an embodiment of the present invention, overlapped information recording media which are carried in an overlapped state are separated from each other by utilizing a frictional force occurred between the separation roller and the information recording medium regardless of a thickness of the information recording medium to be used.

In a case that an attraction force acted between overlapped information recording media carried in an overlapped state is larger than a frictional force between the separation roller and the information recording medium due to the influence of static electricity generated between the overlapped information recording media, a water film occurred due to dew condensation or the like between the overlapped information recording media, or imperfectly dried printing ink between the overlapped information recording media, or the like, the overlapped information recording media which are carried in an overlapped state may be unable to separate from each other by the separation roller. However, according to at least an embodiment of the present invention, the gate part through which one piece of an information recording medium is capable of being passed but two pieces of the information recording medium in an overlapped state are unable to be passed is disposed on a downstream side in a sending-out direction of the information recording medium with respect to the imaginary line which is formed by connecting the rotation center of the feed roller with the rotation center of the separation roller. Therefore, even when the overlapped information recording media which are carried in an overlapped state are unable to be separated from each other by the separation roller, the overlapped information recording media are abutted with the gate part and the overlapped information recording media are separated from each other. Especially, in at least an embodiment of the present invention, the gate part is disposed on a downstream side in the sending-out direction with respect to the imaginary line. Therefore, overlapped information recording media which are carried in an overlapped state are abutted with the gate part in a state that a force in a separating direction is acted on the overlapped information recording media by utilizing a frictional force between the separation roller and the information recording medium. Alternatively, the overlapped information recording media are abutted with the gate part after a force in a separating direction is acted on the overlapped information recording media by utilizing a frictional force between the separation roller and the information recording medium. Accordingly, even when an attraction force acted between information recording media is large, the overlapped information recording media are easily separated from each other by the gate part.

As described above, the medium overlapped-feed preventing mechanism in accordance with at least an embodiment of the present invention includes the separation roller which is oppositely disposed to the feed roller and is urged toward the feed roller and the gate part which is disposed on a downstream side in the sending-out direction with respect to the imaginary line which is formed by connecting the rotation center of the feed roller with the rotation center of the separation roller. Therefore, overlapped information recording media are appropriately separated from each other by the separation roller and the gate part.

In at least an embodiment of the present invention, it is preferable that the gate part is disposed at a position where the front end of the information recording medium in the sending-out direction is reached to the gate part before the rear end of the information recording medium in the sending-out direction is carried out from the feed roller and the separation roller. According to this structure, overlapped information recording media which are carried in an overlapped state are abutted with the gate part by utilizing a frictional force between the separation roller and the information recording medium in a state that a force in the separating direction is acted on the overlapped information recording media. Therefore, even when an attraction force acted between information recording media is large, overlapped information recording media are further easily separated from each other by the gate part.

In at least an embodiment of the present invention, it is preferable that a distance between the imaginary line and the gate part in the sending-out direction is shorter than a radius of the feed roller and a radius of the separation roller. In this case, it is preferable that the gate part is disposed in the vicinity of the imaginary line. According to this structure, when overlapped information recording media which are carried in an overlapped state are abutted with the gate part, a distance is short from a portion of an information recording medium sandwiched by the feed roller and the separation roller to the front end of the information recording medium in the sending-out direction. Therefore, even when the rigidity of an information recording medium to be used is low and the information recording medium is soft, buckling of the information recording medium is prevented when overlapped information recording media are abutted with the gate part.

In at least an embodiment of the present invention, it is preferable that at least surfaces of the feed roller and the separation roller are structured of an elastic member and the gate part is disposed at a position where the front end of the information recording medium in the sending-out direction is reached to the gate part before the front end of the information recording medium in the sending-out direction which is sandwiched by the feed roller and the separation roller is separated from the feed roller and the separation roller which are elastically deformed to their inner sides in their radial directions. According to this structure, even when a front end side of an information recording medium is bent or warped in the sending-out direction of the information recording medium, overlapped information recording media are appropriately separated from each other by the gate part.

In at least an embodiment of the present invention, it is preferable that the gate part is adjacently disposed to the feed roller and the separation roller in a widthwise direction of the information recording medium which is perpendicular to the sending-out direction. According to this structure, even when a front end side of an information recording medium is bent or warped in a widthwise direction of the information recording medium, overlapped information recording media are appropriately separated from each other by the gate part.

In at least an embodiment of the present invention, it is preferable that the gate part is capable of being swung with a direction substantially parallel to an axial direction of a rotation shaft of the feed roller as an axial direction. According to this structure, the gate part is capable of being swung so as to follow an information recording medium which is passed through the gate part. Therefore, even when an information recording medium is made of soft material, buckling of the information recording medium is prevented when the information recording medium is passed through the gate part.

In at least an embodiment of the present invention, it is preferable that the gate mechanism is provided with a gap space adjusting mechanism structured to adjust a gap space of the gate part through which the information recording medium is passed. According to this structure, a gap space of the gate part is capable of being adjusted depending on a thickness of an information recording medium to be used.

In at least an embodiment of the present invention, for example, the gate part is structured of a first gate part and a second gate part which are oppositely disposed to each other in a thickness direction of the information recording medium, and the gate mechanism includes a first gate member in which the first gate part is formed, a second gate member in which the second gate part is formed, and an engaging member which is engaged with the first gate member and the second gate member so that the second gate member is capable of being relatively turned with respect to the first gate member, and a gap space of the gate part is adjusted by relatively turning the second gate member with respect to the first gate member.

In at least an embodiment of the present invention, it is preferable that the gate part is structured of a first gate part and a second gate part which are oppositely disposed to each other in a thickness direction of the information recording medium, the first gate part is disposed on the separation roller side and the second gate part is disposed on the feed roller side, and a rear end of the first gate part in the sending-out direction is formed in an inclined face which is inclined with respect to the sending-out direction toward the second gate part. According to this structure, even when an information recording medium is made of soft material, the information recording medium is appropriately guided to a gap space of the gate part by utilizing an inclined face whose inclination angle is set appropriately.

In at least an embodiment of the present invention, it is preferable that the gate part is structured of a first gate part and a second gate part which are oppositely disposed to each other in a thickness direction of the information recording medium, the first gate part is disposed on the separation roller side and the second gate part is disposed on the feed roller side, and the second gate part is formed so as to extend to an anti-sending-out direction which is an opposite direction to the sending-out direction with respect to the first gate part. According to this structure, an information recording medium is appropriately guided to a gap space of the gate part by utilizing the second gate part.

In at least an embodiment of the present invention, it is preferable that the separation roller is connected with a drive mechanism for the feed roller through a torque limiter. According to this structure, when an information recording medium passing through a gap space of the gate part is carried out, carrying resistance due to a frictional force between the separation roller and an information recording medium can be reduced.

The medium overlapped-feed preventing mechanism in accordance with at least an embodiment of the present invention may be applied to a medium sending-out device which includes a medium accommodating part in which the information recording media are stacked and accommodated, and a medium sending-out mechanism structured to send out the information recording medium which is accommodated in the medium accommodating part to the feed roller and the separation roller. According to the medium sending-out device, overlapped information recording media which are carried in an overlapped state are appropriately separated from each other.

As described above, according to the medium overlapped-feed preventing mechanism and the medium sending-out device in accordance with at least an embodiment of the present invention, overlapped information recording media which are carried in an overlapped state are appropriately separated from each other.

BRIEF DESCRIPTION OF DRAWINGS

Embodiments will now be described, by way of example only, with reference to the accompanying drawings which are meant to be exemplary, not limiting, and wherein like elements are numbered alike in several Figures, in which.

DESCRIPTION OF EMBODIMENTS

An embodiment of the present invention will be described below with reference to the accompanying drawings.

(Schematic Structure of Medium Sending-Out Device)

Figure 1:
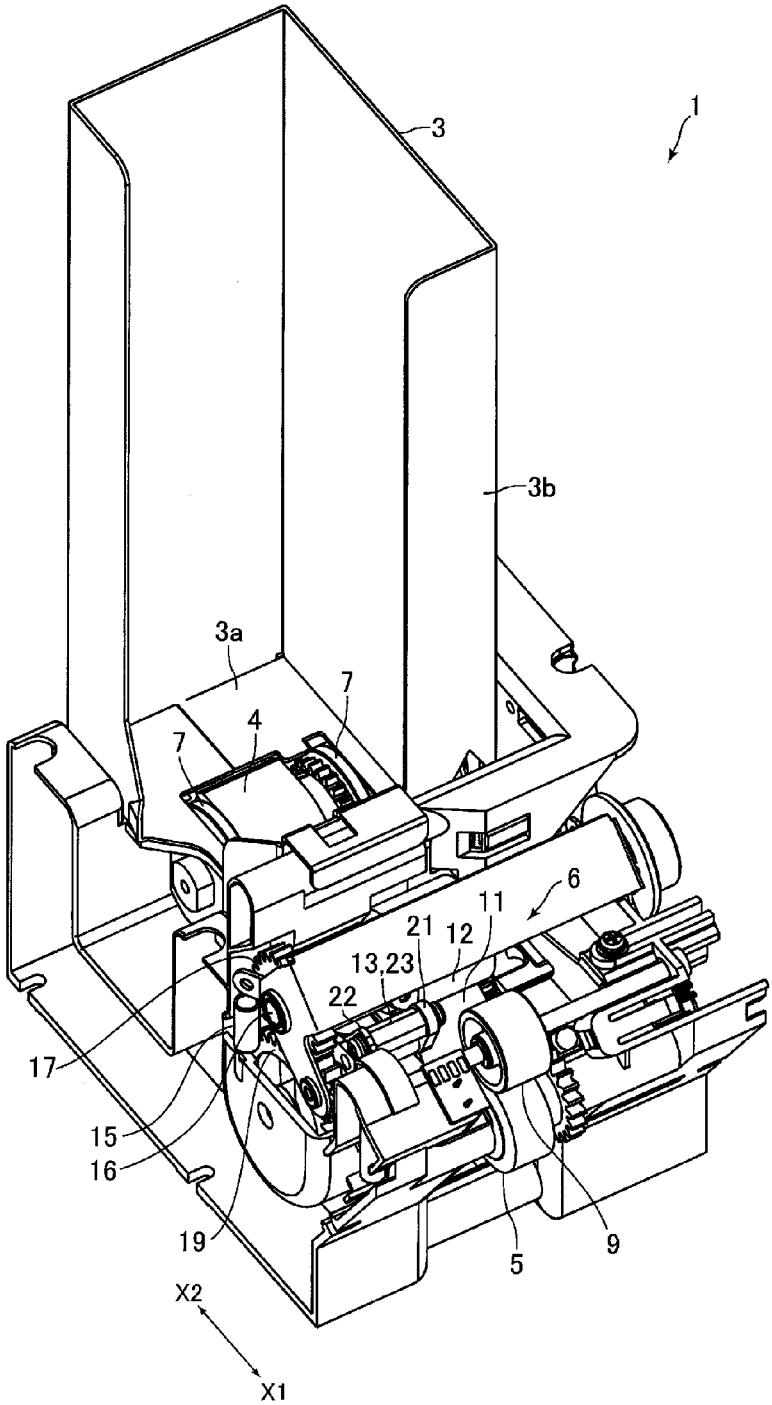
FIG. 1 is a perspective view showing a medium sending-out device in accordance with an embodiment of the present invention.
Figure 2:
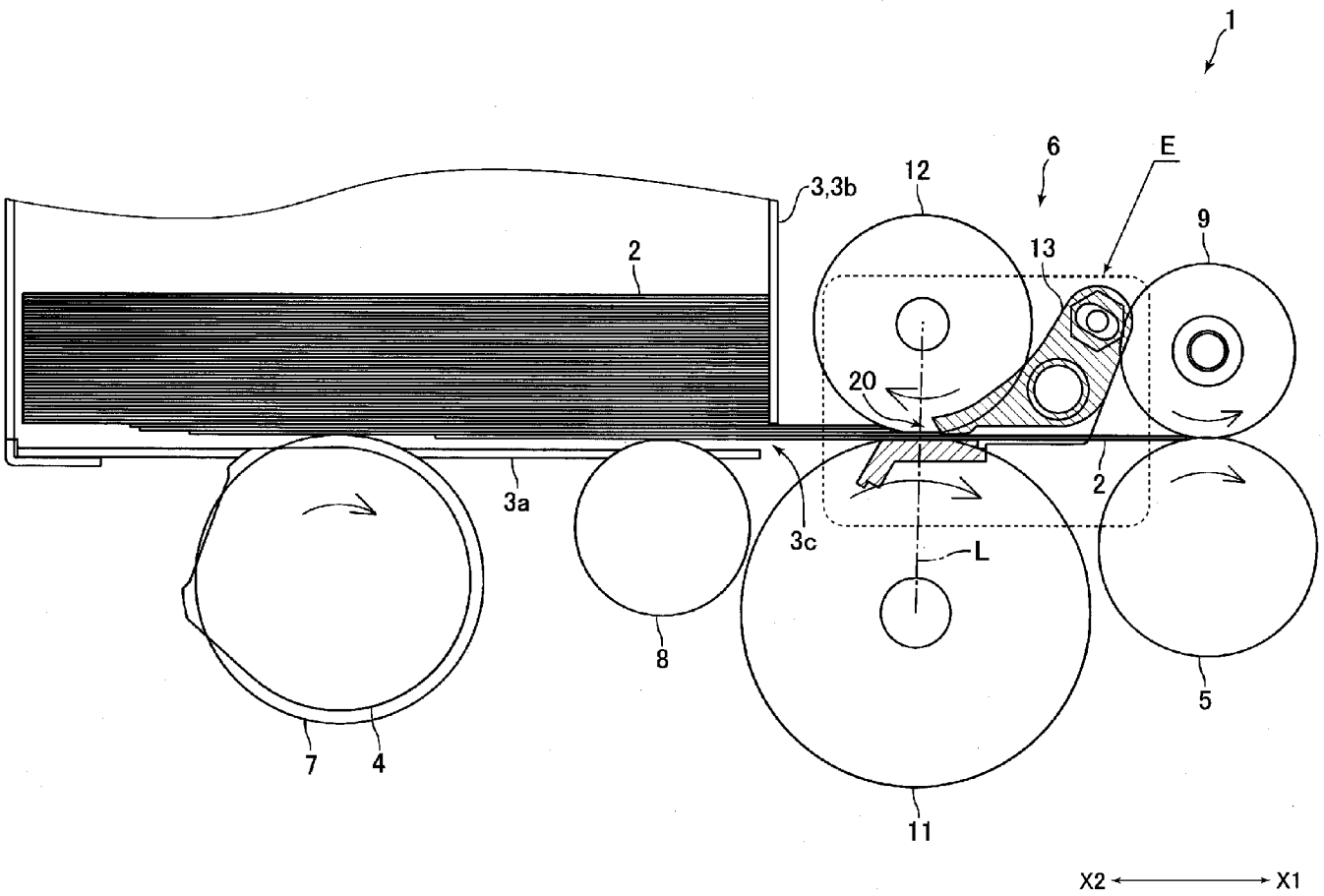
FIG. 2 is an explanatory side view showing a schematic structure of a part of the medium sending-out device shown in FIG. 1.
Figure 3:
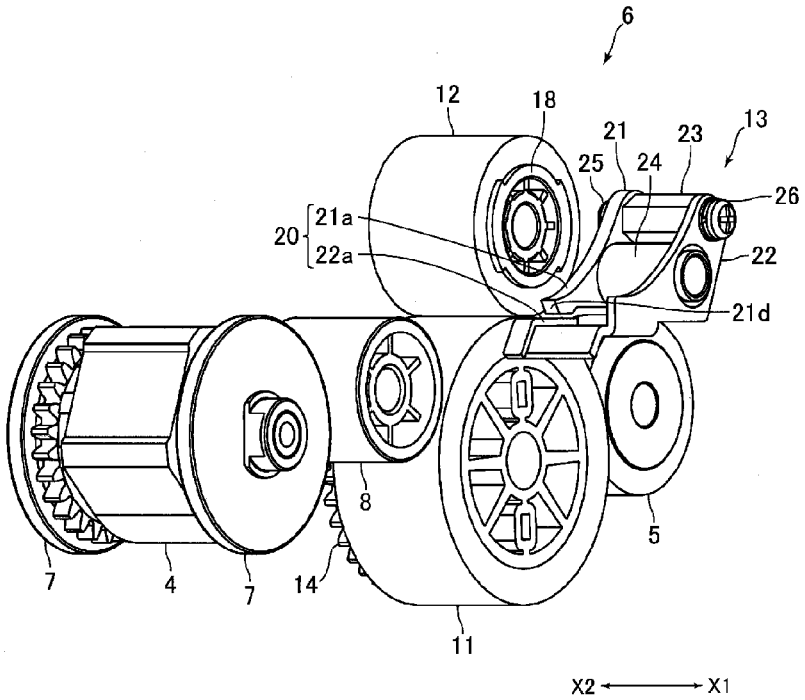
FIG. 3 is a perspective view showing sending-out rollers, a medium overlapped-feed preventing mechanism and the like shown in FIG. 2 which are viewed from a rear side of the medium sending-out device.

FIG. 1 is a perspective view showing a medium sending-out device 1 in accordance with an embodiment of the present invention. FIG. 2 is an explanatory side view showing a schematic structure of a part of the medium sending-out device 1 shown in FIG. 1. FIG. 3 is a perspective view showing sending-out rollers 4 and 5, a medium overlapped-feed preventing mechanism 6 and the like shown in FIG. 2 which are viewed from a rear side of the medium sending-out device 1.

The medium sending-out device 1 in this embodiment is a device which is structured to send out a card 2, i.e., an information recording medium to a predetermined direction. In this embodiment, a card 2 is sent out to an "X1" direction side in FIGS. 1 and 2 and the like. In other words, the "X1" direction is the sending-out direction of a card 2. Further, an "X2" direction which is an opposite direction to the "X1" direction is anti-sending-out direction. In the following descriptions, the "X1" direction side in FIG. 1 is referred as a "front" side of the medium sending-out device 1 and the "X2" direction side is referred as a "rear (back)" of the medium sending-out device 1.

The medium sending-out device 1 includes a card accommodating part 3 as a medium accommodating part in which a plurality of cards 2 is stacked and accommodated in an upper and lower direction, a sending-out roller 4 as a medium sending-out mechanism structured to send out a card 2 accommodated at the lowest position of a plurality of the cards 2 accommodated in the card accommodating part 3 to a front face side of the medium sending-out device 1, a sending-out roller 5 structured to further send out the card 2 which is sent out by the sending-out roller 4 to the front face side of the medium sending-out device 1, and a medium overlapped-feed preventing mechanism 6 structured to send out a card 2 one at a time in an overlapped state in the card accommodating part 3.

The card 2 which is used in the medium sending-out device 1 in this embodiment is a card made of vinyl chloride whose thickness is about 0.7-0.8 mm, a PET (polyethylene terephthalate) card whose thickness is about 0.18-0.36 mm, a paper card having a predetermined thickness, or the like. In other words, cards 2 having various thicknesses are capable of being used in the medium sending-out device 1 in this embodiment. Further, cards 2 having various rigidities from a relatively soft card 2 to a relatively hard card 2 are capable of being used in the medium sending-out device 1 in this embodiment. The card 2 is, for example, a non-contact type IC card and the card 2 is incorporated with an antenna for communication. A magnetic stripe may be formed on the surface of the card 2 and an IC chip may be fixed to the card 2.

The card accommodating part 3 is formed in a rectangular parallelepiped box shape in which a part of its side face and its upper face are opened. An opening part 3*c* through which a card 2 accommodated in the card accommodating part 3 is passed toward a front side is formed between a bottom face part 3*a* of the card accommodating part 3 and a lower end of its front side wall part 3*b* as shown in FIG. 2. The opening part 3*c* is formed so that a plurality of the cards 2 is capable of being passed.

The sending-out roller 4 is an eccentric roller. An upper end side of the sending-out roller 4 is disposed in a through hole which is formed in the bottom face part 3*a*. A motor not shown is connected with the sending-out roller 4. Further, support rollers 7 and 8 which supports the cards 2 accommodated in the card accommodating part 3 from a lower side are disposed on the lower side with respect to the card accommodating part 3. The support roller 7 is coaxially disposed with the sending-out roller 4. The support roller 8 is disposed on the front side with respect to the support roller 7.

The sending-out roller 5 is disposed on a lower side of a carrying passage for a card 2 so as to be capable of being abutted with the under face of the card 2. A motor not shown is connected with the sending-out roller 5. Further, a pad roller 9 is oppositely disposed to the sending-out roller 5 on an upper side with respect to the sending-out roller 5. The pad roller 9 is urged toward the sending-out roller 5.

The medium overlapped-feed preventing mechanism 6 is disposed between the sending-out roller 5 and the pad roller 9 and the card accommodating part 3. A structure of the medium overlapped-feed preventing mechanism 6 will be described below.

(Structure of Medium Overlapped-Feed Preventing Mechanism)

Figure 4:
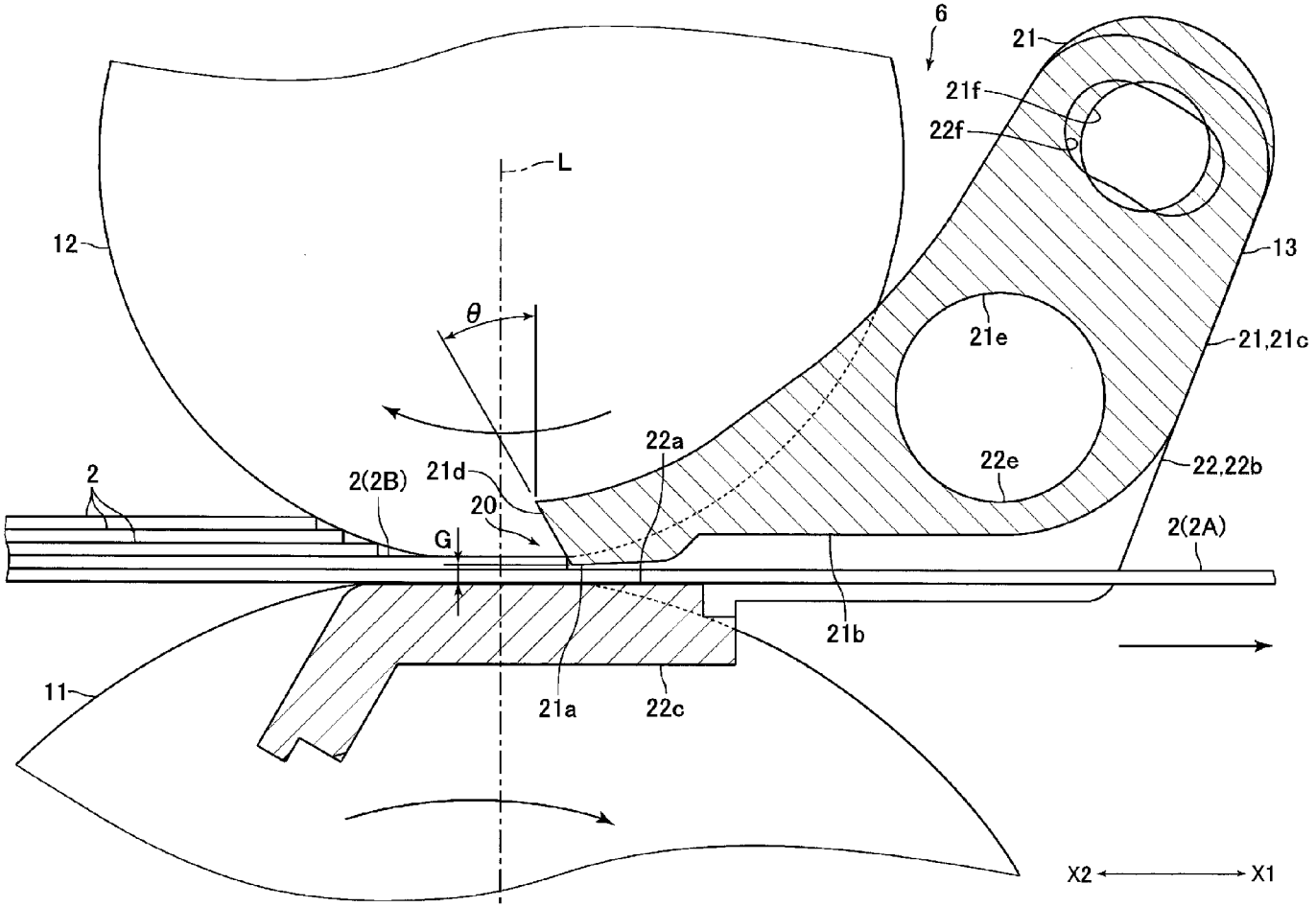
FIG. 4 is an enlarged view showing the "E" part in FIG. 2.
Figure 5:
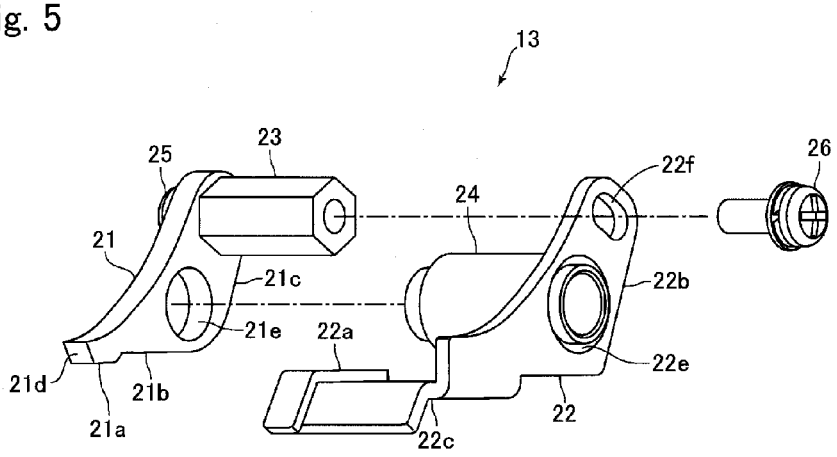
FIG. 5 is an exploded perspective view showing a gate mechanism in FIG. 3.

FIG. 4 is an enlarged view showing the "E" part in FIG. 2. FIG. 5 is an exploded perspective view showing a gate mechanism 13 in FIG. 3.

The medium overlapped-feed preventing mechanism 6 includes a feed roller 11 structured to abut with a card 2 and to carry the card 2, a separation roller 12 for separating cards 2 carried toward the sending-out roller 5 in a state that plural cards are overlapped (in other words, carried in an overlapped state), and a gate mechanism 13 which is disposed on the front side with respect to the feed roller 11 and the separation roller 12.

The feed roller 11 is a rubber roller whose outer peripheral side is provided with a rubber tire. In other words, the surface of the feed roller 11 is structured of rubber which is an elastic member. The feed roller 11 is disposed on a lower side of the carrying passage for a card 2 so as to be capable of being abutted with an under face of the card 2. The feed roller 11 is connected with a motor (not shown) through a gear train including a gear 14 (see FIG. 3). A drive mechanism for the feed roller 11 is structured of the gear train, the motor and the like.

The separation roller 12 is, similarly to the feed roller 11, a rubber roller whose outer peripheral side is provided with a rubber tire. In other words, the surface of the separation roller 12 is structured of rubber which is an elastic member. The separation roller 12 is oppositely disposed to the feed roller 11 from an upper side of the feed roller 11. Further, the separation roller 12 is urged toward the feed roller 11 by an urging force of an urging member 15 (see FIG. 1). For example, the urging member 15 is a tension coil spring. As shown in FIG. 1, a rotation shaft 16 of the separation roller 12 is fixed with a gear 17 which is engaged with a gear 19 that is fixed to a rotation shaft of the feed roller 11. The separation roller 12 is attached to the rotation shaft 16 through a torque limiter 18 (see FIG. 3). In other words, the separation roller 12 is connected with the drive mechanism for the feed roller 11 through the torque limiter 18, the rotation shaft 16, the gear 17 and the like.

The separation roller 12 in this embodiment is rotated in the same direction as the feed roller 11 in order to separate cards 2 in an overlapped-feed state. In other words, when a card 2 is to be sent out from the card accommodating part 3, the feed roller 11 is rotated in a clockwise direction in FIGS. 2 and 4, and the separation roller 12 is also rotated in the clockwise direction in FIGS. 2 and FIG. 4. Therefore, when a plurality of cards 2 in an overlapped state is sent out from the card accommodating part 3, the card 2 whose under face is abutted with the feed roller 11 is carried to the front side and the card 2 whose upper face is abutted with the separation roller 12 is returned to a side of the card accommodating part 3 (in other words, to the rear side).

As described above, the feed roller 11 and the separation roller 12 are a rubber roller and the separation roller 12 is urged toward the feed roller 11. In this embodiment, in a state that the cards 2 are sandwiched between the feed roller 11 and the separation roller 12, the feed roller 11 and the separation roller 12 are elastically deformed toward their inner sides in the radial direction and the feed roller 11 and a card 2 are brought into surface contact with each other and the separation roller 12 and another card 2 are brought into surface contact with each other.

A gate part 20 having a gap space "G" through which a card 2 is capable of being passed is formed in the gate mechanism 13 as shown in FIG. 4. The gap space "G" of the gate part 20 is set so that one piece of a card 2 is capable of being passed but two pieces of the card 2 in an overlapped state are unable to be passed. For example, the gap space "G" is set in a gap space having the same width as a thickness of about 1.5 pieces of the card 2. Further, the gate part 20 is structured of a first gate part 21*a* and a second gate part 22*a* which are oppositely disposed to each other in a thickness direction of the card 2. In other words, a space between the first gate part 21*a* and the second gate member 22*a* is the gap space "G" of the gate part 20. In this embodiment, the first gate part 21*a* is disposed on the separation roller 12 side (in other words, an upper side) and the second gate part 22*a* is disposed on the feed roller 11 side (in other words, a lower side).

The first gate part 21*a* is, as shown in FIG. 5, formed in a first gate member 21 which is formed in a flat plate shape. The first gate member 21 is structured of a rear end side part 21*b* formed so as to extend toward the front direction and a front end side part 21*c* which is formed so as to extend to an obliquely front upper direction from a front end side of the rear end side part 21*b*, and the rear end part of the rear end side part 21*b* is formed as the first gate part 21*a*. As shown in FIG. 4, a lower end face of the first gate part 21*a* is protruded to a lower side with respect to a lower end face of the other portion of the rear end side part 21*b*.

A rear end of the first gate part 21*a* is formed to be an inclined face 21*d* which is inclined in an upper direction toward the rear side. An angle "θ" (see FIG. 4) of the inclined face 21*d* with respect to the upper and lower direction is set to be slightly larger than a friction angle between the inclined face 21*d* and a front end face of a card 2. Therefore, when a front end face of one piece of a card 2 which is carried toward the gate part 20 in a state that cards are not overlapped is abutted with the inclined face 21*d*, the card 2 is guided by the inclined face 21*d* and is entered into the gate part 20. Further, in a state that two cards are overlapped, an upper side card 2 of two overlapped cards which are carried to the gate part 20 is prevented from entering into the gate part 20. For example, the angle "θ" is set to be in a range of about 16° through 30°.

A round hole-shaped through hole 21*e* is formed at a substantially center of the first gate member 21. Further, a round hole-shaped through hole 21*f* is also formed on an upper end side of the first gate member 21.

The second gate part 22*a* is, as shown in FIG. 5, formed in the second gate member 22 which is formed by bending a flat plate-shaped member. The second gate member 22 is structured of a side face part 22*b*, which is disposed in substantially parallel to the first gate member 21 with a predetermined distance therebetween and a bottom face part 22*c* which is formed so as to extend toward the first gate member 21 from a lower end side of the side face part 22*b*.

The side face part 22*b* is formed to be substantially the same shape as the first gate member 21. However, a rear end side of the side face part 22*b* is extended to a rear side with respect to the rear end of the first gate member 21. A round hole-shaped through hole 22*e* is formed at a substantially center of the side face part 22*b* and an elongated hole-shaped through hole 22*f* is formed on an upper end side of the side face part 22*b*.

The bottom face part 22*c* is formed in a substantially flat shape so as to extend toward the first gate member 21 from a rear end side portion of the side face part 22*b*. A portion on a first gate member 21 side of the bottom face part 22*c* is structured to be a second gate part 22*a* and an under face of the first gate part 21*a* and an upper face of the second gate part 22*a* are faced each other in the upper and lower direction through the gap space "G". The upper face of the second gate part 22*a* is protruded to an upper side from an upper face of the other portion of the bottom face part 22*c*. Further, a rear end side of the bottom face part 22*c* is bent so as to incline in a lower direction toward the rear side. As described above, the rear end side of the side face part 22*b* is extended toward the rear side with respect to the rear end of the first gate member 21 and the second gate part 22*a* is extended to the rear side with respect to the first gate part 21*a*.

A hexagonal prism-shaped shaft member 23 is disposed between the first gate member 21 and the side face part 22*b* of the second gate member 22. Each of both ends of the shaft member 23 is formed with a female screw and a screw 25 inserted into a through hole 21*f* of the first gate member 21 and a screw 26 inserted into a through hole 22*f* of the second gate member 22 are respectively engaged with the female screw. The first gate member 21 and the second gate member 22 are fixed to each other by the shaft member 23 and the screws 25 and 26.

Further, a tube member 24 formed in a substantially cylindrical tube shape is disposed between the first gate member 21 and the side face part 22*b* of the second gate member 22. One end of the tube member 24 is fixed to the side face part 22*b* in a state that its one end is inserted into the through hole 22*e*. On the other hand, the other end of the tube member 24 is inserted into the through hole 21*e* but is not fixed to the first gate member 21. A fixed shaft (not shown) which is fixed to a frame of the medium sending-out device 1 is inserted into an inner peripheral side of the tube member 24. The fixed shaft is disposed in a substantially parallel to an axial direction of the rotation shaft of the feed roller 11. In this embodiment, the first gate member 21 and the second gate member 22 are capable of being slightly swung with the fixed shaft as a swing center in a state that the first gate member 21 and the second gate member 22 are fixed to each other. In other words, the gate part 20 is capable of being slightly swung in the upper and lower direction with the center axis of the tube member 24 as a swing center.

In this embodiment, when the screw 26 is loosened and the second gate member 22 is relatively turned with respect to the first gate member 21 with the tube member 24 as a center, the gap space "G" of the gate part 20 is adjusted. In other words, in this embodiment, a gap space adjusting mechanism for adjusting the gap space of the gate part 20 is structured of the shaft member 23, the tube member 24, the screw 26 and the like. The tube member 24 in this embodiment is an engaging member which is engaged with the first gate member 21 and the second gate member 22 so that the second gate member 22 is capable of being relatively turned to the first gate member 21.

The gate part 20 is, as shown in FIG. 4, disposed on the front side with respect to an imaginary line "L" which is formed by connecting the rotation center of the feed roller 11 with the rotation center of the separation roller 12. In this embodiment, the gate part 20 is disposed at a position where the front end of a card 2 is reached to the gate part 20 before the rear end of the card 2 is carried out between the feed roller 11 and the separation roller 12. Specifically, the gate part 20 is disposed in the vicinity of the imaginary line "L" (more specifically, a slightly front side with respect to the imaginary line "L") and a distance between the imaginary line "L" and the gate part 20 in the front and rear direction is shorter than a radius of the feed roller 11 and a radius of the separation roller 12.

Further, in this embodiment, the gate part 20 is disposed at a position where a front end of a card 2 is reached to the gate part 20 before the front end of the card 2 in a state sandwiched by the feed roller 11 and the separation roller 12 is separated from the feed roller 11 and the separation roller 12 which are elastically deformed to their inner sides in the radial direction. In other words, when the front end of a card 2 is reached to the gate part 20, the front end of the card 2 is sandwiched by the feed roller 11 and the separation roller 12 which are elastically deformed and is abutted with the feed roller 11 and the separation roller 12.

Further, as shown in FIG. 3, the first gate member 21 and the second gate member 22 are disposed on a front side in the paper surface of FIG. 3 (front side in the paper surface of FIG. 2) with respect to the feed roller 11 and the separation roller 12. Specifically, the first gate member 21 and the second gate member 22 are disposed so that the gate part 20 is adjacently disposed to the feed roller 11 and the separation roller 12 in a widthwise direction of a card 2 (direction perpendicular to the paper surface of FIG. 2) which is perpendicular to the front and rear direction. The gate part 20 is adjacently disposed to the feed roller 11 and the separation roller 12 through a slight gap space in the widthwise direction of a card 2. In this embodiment, the rear end of the first gate part 21*a* is disposed on the front side with respect to the imaginary line "L" and the rear end of the second gate part 22*a* is disposed on the rear side with the imaginary line "L".

(Schematic Operation of Medium Sending-Out Device)

In the medium sending-out device 1 structured as described above, when one piece of a card 2 is sent out from the card accommodating part 3 by the sending-out roller 4, the card 2 is passed through the gate part 20 and is further sent out to the front side by the sending-out roller 5. The gate part 20 is capable of being swung in the upper and lower direction with the center axis of the tube member 24 as a center and thus, when a card 2 is passed through the gate part 20, the gate part 20 is swung so as to follow a shape and movement of the card 2. In a case that one piece of a card 2 is sent out from the card accommodating part 3, even when the front end face of the card 2 is abutted with the inclined face 21*d*, the front end face of the card 2 is guided to the gate part 20 by the inclined face 21*d*.

On the other hand, when two or more pieces of a card are sent out from the card accommodating part 3 in an overlapped state, (in other words, cards are carried in an overlapped-feed state), cards except the lowest card 2A (see FIG. 4) are returned to the rear side by the operation of the separation roller 12. In this embodiment, when an attraction force acted between overlapped cards 2A and 2B carried in an overlapped-feed state is larger than a frictional force between the card 2B abutted with the separation roller 12 and the separation roller 12 due to the influence of static electricity generated between the overlapped cards 2A and 2B (see FIG. 4), a water film occurred due to dew condensation or the like between the overlapped cards 2A and 2B, or imperfectly dried printing ink between the overlapped cards 2A and 2B, or the like, as shown in FIG. 4, a front end of the card 2B may be passed the imaginary line "L". In this case, the front end of the card 2B which is passed the imaginary line "L" is immediately abutted with the inclined face 21*d* of the first gate part 21*a* structuring the gate part 20 and thereby the card 2A and the card 2B are separated from each other. Further, the card 2B separated from the card 2A is returned to the rear side by the operation of the separation roller 12.

(Principal Effects in this Embodiment)

As described above, in this embodiment, the separation roller 12 which is structured to rotate in the same direction as the feed roller 11 for separating overlapped cards 2 which are carried in an overlapped-feed state is urged toward the feed roller 11. Therefore, when a card 2 is passed through between the feed roller 11 and the separation roller 12, the separation roller 12 is moved to the upper and lower direction depending on the thickness of the card 2 which is used. Accordingly, in this embodiment, the separation roller 12 is capable of being abutted with a card 2 regardless of the thickness of the card 2 which is used. As a result, in this embodiment, overlapped cards 2 which are carried in an overlapped-feed state are separated from each other by utilizing a frictional force occurred between the separation roller 12 and the card 2 regardless of the thickness of the card 2 which is used.

Further, in this embodiment, the gate part 20 is disposed on the front side with respect to the imagination line "L" which is formed by connecting the rotation center of the feed roller 11 with the rotation center of the separation roller 12. Therefore, even when an attraction force acted on overlapped cards 2 which are carried in an overlapped-feed state is larger than a frictional force between the card 2 abutted with the separation roller 12 and the separation roller 12 and thereby the overlapped cards 2 are unable to be separated by the separation roller 12, the overlapped cards 2 which are carried in an overlapped-feed state are abutted with the inclined face 21*d* of the first gate part 21*a* and the overlapped cards 2 are separated from each other.

Especially, in this embodiment, the front end of a card 2 is reached to the gate part 20 before the rear end of the card 2 is carried out from a position between the feed roller 11 and the separation roller 12. Therefore, the overlapped cards 2 which are carried in an overlapped-feed state are abutted with the inclined face 21*d* of the first gate part 21*a* in a state that a force in a separating direction is applied to the overlapped cards by utilizing the frictional force between the separation roller 12 and the card 2. Accordingly, in this embodiment, even when the attraction force acted on the overlapped cards 2 is large, the overlapped cards 2 are further easily separated from each other in the gate part 20.

As described above, the medium overlapped-feed preventing mechanism 6 in this embodiment includes the separation roller 12, which is urged toward the feed roller 11, and the gate part 20 disposed on the front side with respect to the imaginary line "L" which is formed by connecting the rotation center of the feed roller 11 with the rotation center of the separation roller 12. Therefore, the overlapped cards 2 are appropriately separated from each other by the separation roller 12 and the gate part 20.

In this embodiment, the gate part 20 is disposed at a position where the front end of a card 2 is reached to the gate part 20 before the front end of the card 2 sandwiched by the feed roller 11 and the separation roller 12 is separated from the feed roller 11 and the separation roller 12 which are elastically deformed to their inner sides in the radial direction. Therefore, when the overlapped cards 2 which are carried in an overlapped-feed state are abutted with the gate part 20, the front ends of the cards 2 are sandwiched by the feed roller 11 and the separation roller 12. Accordingly, even when the rigidity of a card 2 to be used is low and the card 2 is soft, buckling of the card 2 at the time of abutting with the gate part 20 is prevented.

Further, in this embodiment, the gate part 20 is capable of slightly swinging with the center axis of the tube member 24 as a center and thus, when a card 2 is passed through the gate part 20, the gate part 20 is swung so as to follow the shape and movement of the card 2. Therefore, even in a case that the card 2 is soft, buckling of the card 2 is prevented when the card 2 is passed through the gate part 20.

In this embodiment, the gate part 20 is disposed at the position where the front end of a card 2 is reached to the gate part 20 before the front end of the card 2 sandwiched by the feed roller 11 and the separation roller 12 is separated from the feed roller 11 and the separation roller 12 which are elastically deformed to their inner sides in the radial direction. Therefore, even when a front end side of a card 2 is bent or warped in a longitudinal direction (front and rear direction) of the card 2, the front end of the card 2 is prevented from entering into a space between the separation roller 12 and the first gate member 21 in the upper and lower direction. As a result, overlapped cards 2 which are carried in an overlapped-feed state are appropriately separated from each other by the gate part 20.

Further, in this embodiment, the gate part 20 is disposed so as to be adjacent to the feed roller 11 and the separation roller 12 in the widthwise direction of a card 2. Therefore, even when the front end side of a card 2 is bent or warped in the widthwise direction of the card 2, the front end of the card 2 is prevented from entering into a space between the separation roller 12 and the first gate member 21 in the widthwise direction of the card 2. As a result, overlapped cards 2 which are carried in an overlapped-feed state are appropriately separated from each other by the gate part 20.

In this embodiment, when the screw 26 is loosened and the second gate member 22 is relatively turned with respect to the first gate member 21 with the tube member 24 as a center, the gap space "G" of the gate part 20 is adjusted. Therefore, the gap space "G" of the gate part 20 can be adjusted depending on the thickness of a card 2 to be used.

In this embodiment, the angle "θ" of the inclined face 21*d* in the upper and lower direction is set to be slightly larger than the friction angle between the inclined face 21*d* and the front end face of the card 2. Therefore, even when a card 2 is soft, one piece of a card 2 which is carried toward the gate part 20 in a state that the card 2 is not overlapped is capable of being guided to the gap space "G" of the gate part 20 by the inclined face 21*d*. Further, an upper side card 2 of two overlapped cards 2 which are carried to the gate part 20 is prevented from entering into the gate part 20.

In this embodiment, the second gate part 22*a* is extended toward the rear side with respect to the first gate part 21*a*. Therefore, a card 2 is capable of being appropriately guided to the gap space "G" of the gate part 20 by utilizing the second gate part 22*a*. Further, in this embodiment, the rear end side of the bottom face part 22*c* is bent so as to incline to a lower direction toward the rear side and thus a card 2 is appropriately guided to an upper face of the second gate part 22*a* by utilizing the rear end side of the bottom face part 22*c*.

In this embodiment, the separation roller 12 is connected with the drive mechanism for the feed roller 11 through the torque limiter 18, the rotation shaft 16, the gear 17 and the like. Therefore, when a card 2 passing through the gap space "G" of the gate part 20 is sent out, carrying resistance due to a frictional force between the separation roller 12 and the card 2 is reduced.

(Other Embodiments)

Although the present invention has been shown and described with reference to a specific embodiment, various changes and modifications will be apparent to those skilled in the art from the teachings herein.

In the embodiment described above, the gate part 20 is disposed at the position where the front end of a card 2 is reached to the gate part 20 before the front end of the card 2 sandwiched by the feed roller 11 and the separation roller 12 is separated from the feed roller 11 and the separation roller 12 which are elastically deformed to their inner sides in the radial direction. However, the present invention is not limited to this embodiment. For example, the gate part 20 is disposed at a position where the front end of a card 2 is reached to the gate part 20 after the front end of the card 2 sandwiched by the feed roller 11 and the separation roller 12 is separated from the feed roller 11 and the separation roller 12. Also in this case, in a case that the gate part 20 is disposed in the comparatively vicinity of the imaginary line "L", a distance of a card 2 from its portion sandwiched by the feed roller 11 and the separation roller 12 to the front end of the card 2 is short when the overlapped cards are abutted with the gate part 20. Therefore, even when the rigidity of a card 2 to be used is low and soft, buckling of the card 2 is capable of being prevented when the overlapped cards 2 are abutted with the gate part 20.

Further, instead of disposing in the comparatively vicinity of the imaginary line "L", the gate part 20 may be disposed at a remote position from the imaginary line "L". In this case, the gate part 20 may be disposed at a position where the front end of a card 2 is reached to the gate part 20 after the rear end of the card 2 is carried out from a position between the feed roller 11 and the separation roller 12. Further, in the embodiment described above, the gate part 20 is provided so as to be capable of being swung with the center axis of the tube member 24 as a center but the gate part 20 may be fixed.

In the embodiment described above, the medium sending-out mechanism which is structured to send out a card 2 to the front face side of the medium sending-out device 1 is the sending-out roller 4. However, the medium sending-out mechanism may be structured of a pawl member which is structured to abut with a rear end face of a card 2, a pawl member drive mechanism for driving the pawl member and the like. Further, in the embodiment described above, the structure of the medium overlapped-feed preventing mechanism 6 in accordance with an embodiment of the present invention is described with reference to the medium sending-out device 1 as an example. However, the medium overlapped-feed preventing mechanism 6 may be used in various devices which are required to prevent from carrying media in an overlapped-feed state.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

The invention claimed is:

1. A medium overlapped-feed preventing mechanism structured to send out an information recording medium one at a time in a state that a plurality of information recording media is overlapped, comprising:

a feed roller which is structured to abut with the information recording medium and carry the information recording medium;

a separation roller which is oppositely disposed to the feed roller and is urged toward the feed roller and is rotated in the same direction as the feed roller for separating overlapped information recording media which are carried in an overlapped-feed state; and a gate mechanism provided with a gate part through which one piece of the information recording medium is capable of being passed but two pieces of the information recording medium in an overlapped state are unable to be passed;

wherein the gate part is disposed on a downstream side in a sending-out direction of the information recording medium with respect to an imaginary line which is formed by connecting a rotation center of the feed roller with a rotation center of the separation roller; and wherein the gate part is structured of a first gate part and a second gate part which are oppositely disposed to each other in a thickness direction of the information recording medium, the first gate part is disposed on a separation roller side and the second gate part is disposed on a feed roller side, and the second gate part is formed so as to extend to an anti-sending-out direction which is an opposite direction to a sending-out direction with respect to the first gate part.

2. The medium overlapped-feed preventing mechanism according to claim 1, wherein the gate part is disposed in a vicinity of the imaginary line.

3. The medium overlapped-feed preventing mechanism according to claim 1, wherein the gate part is disposed so as to be adjacent to the feed roller and the separation roller in a widthwise direction of the information recording medium which is perpendicular to the sending-out direction.

4. The medium overlapped-feed preventing mechanism according to claim 1, wherein the gate part is capable of being swung with a direction substantially parallel to an axial direction of a rotation shaft of the feed roller as an axial direction.

5. The medium overlapped-feed preventing mechanism according to claim 1, wherein the gate mechanism is provided with a gap space adjusting mechanism structured to adjust a gap space of the gate part through which the information recording medium is passed.

6. The medium overlapped-feed preventing mechanism according to claim 5, wherein the gate part is structured of the first gate part and the second gate part which are oppositely disposed to each other in a thickness direction of the information recording medium, the gate mechanism comprises:

a first gate member in which the first gate part is formed;

a second gate member in which the second gate part is formed; and an engaging member which is engaged with the first gate member and the second gate member so that the second gate member is capable of being relatively turned with respect to the first gate member; and a gap space of the gate part is adjusted by relatively turning the second gate member with respect to the first gate member.

7. The medium overlapped-feed preventing mechanism according to claim 1, wherein the gate part is structured of the first gate part and the second gate part which are oppositely disposed to each other in a thickness direction of the information recording medium, the first gate part is disposed on a separation roller side and the second gate part is disposed on a feed roller side, and a rear end of the first gate part in the sending-out direction is formed in an inclined face which is inclined with respect to the sending-out direction toward the second gate part.

8. The medium multi-feed preventing mechanism according to claim 1, wherein the separation roller is connected with a drive mechanism for the feed roller through a torque limiter.

9. A medium sending-out device comprising:

a medium overlapped-feed preventing mechanism structured to send out an information recording medium one at a time in a state that a plurality of information recording media is overlapped, comprising:

a feed roller which is structured to abut with the information recording medium and carry the information recording medium;

a separation roller which is oppositely disposed to the feed roller and is urged toward the feed roller and is rotated in the same direction as the feed roller for separating overlapped information recording media which are carried in an overlapped-feed state; and a gate mechanism provided with a gate part through which one piece of the information recording medium is capable of being passed but two pieces of the information recording medium in an overlapped state are unable to be passed;

wherein the gate part is disposed on a downstream side in a sending-out direction of the information recording medium with respect to an imaginary line which is formed by connecting a rotation center of the feed roller with a rotation center of the separation roller;

a medium accommodating part in which the information recording media are stacked and accommodated;

a medium sending-out mechanism structured to send out the information recording medium which is accommodated in the medium accommodating part to the feed roller and the separation roller; and wherein the gate part is structured of a first gate part and a second gate part which are oppositely disposed to each other in a thickness direction of the information recording medium, the first gate part is disposed on a separation roller side and the second gate part is disposed on a feed roller side, and the second gate part is formed so as to extend to an anti-sending-out direction which is an opposite direction to a sending-out direction with respect to the first gate part.

10. A medium overlapped-feed preventing mechanism structured to send out an information recording medium one at a time in a state that a plurality of information recording media is overlapped, comprising:

a feed roller which is structured to abut with the information recording medium and carry the information recording medium;

a separation roller which is oppositely disposed to the feed roller and is urged toward the feed roller and is rotated in the same direction as the feed roller for separating overlapped information recording media which are carried in an overlapped-feed state; and a gate mechanism provided with a gate part through which one piece of the information recording medium is capable of being passed but two pieces of the information recording medium in an overlapped state are unable to be passed;

wherein the gate part is disposed on a downstream side in a sending-out direction of the information recording medium with respect to an imaginary line which is formed by connecting a rotation center of the feed roller with a rotation center of the separation roller;

wherein the gate mechanism is provided with a gap space adjusting mechanism structured to adjust a gap space of the gate part through which the information recording medium is passed;

wherein the gate part is structured of a first gate part and a second gate part which are oppositely disposed to each other in a thickness direction of the information recording medium, the gate mechanism comprises:

a first gate member in which the first gate part is formed;

a second gate member in which the second gate part is formed; and an engaging member which is engaged with the first gate member and the second gate member so that the second gate member is capable of being relatively turned with respect to the first gate member; and a gap space of the gate part is adjusted by relatively turning the second gate member with respect to the first gate member.

11. A medium overlapped-feed preventing mechanism structured to send out an information recording medium one at a time in a state that a plurality of information recording media is overlapped, comprising:

a feed roller which is structured to abut with the information recording medium and carry the information recording medium;

a separation roller which is oppositely disposed to the feed roller and is urged toward the feed roller and is rotated in the same direction as the feed roller for separating overlapped information recording media which are carried in an overlapped-feed state; and a gate mechanism provided with a gate part through which one piece of the information recording medium is capable of being passed but two pieces of the information recording medium in an overlapped state are unable to be passed;

wherein the gate part is disposed on a downstream side in a sending-out direction of the information recording medium with respect to an imaginary line which is formed by connecting a rotation center of the feed roller with a rotation center of the separation roller; and wherein the gate part is structured of a first gate part and a second gate part which are oppositely disposed to each other in a thickness direction of the information recording medium, the first gate part is disposed on a separation roller side and the second gate part is disposed on a feed roller side, and a rear end of the first gate part in the sending-out direction is formed in an inclined face which is inclined with respect to the sending-out direction toward the second gate part.

* * * * *